United States Patent [19]

Willie

[11] Patent Number: 4,626,457

[45] Date of Patent: Dec. 2, 1986

[54] VERSATILE MINIPURSE

[76] Inventor: Kenneth W. Willie, 7536-26th Ave., Kenosha, Wis. 53240

[21] Appl. No.: 790,940

[22] Filed: Oct. 24, 1985

[51] Int. Cl.[4] ..... A45C 1/02

[52] U.S. Cl. ..... 428/35; D3/53; 150/137

[58] Field of Search ..... D2/407; D3/53; 150/136, 150/137, 900; 428/35, 99

[56] References Cited

U.S. PATENT DOCUMENTS

| | | | |
|---|---|---|---|
| Re. 24,166 | 6/1956 | Stiller | D3/53 X |
| D. 138,985 | 10/1944 | Ornsteen | 2/407 |
| D. 142,357 | 9/1945 | Younghusband | 2/407 |
| D. 169,825 | 6/1953 | Schildkraut | D2/407 |
| D. 170,796 | 11/1953 | Del Mas | D2/407 |
| D. 186,933 | 12/1959 | Sapiro | D2/407 |
| 979,806 | 12/1910 | Snyder | 150/137 X |
| 1,138,882 | 5/1915 | Meier | 150/900 X |
| 2,298,945 | 10/1942 | Hyatt | 150/137 X |
| 2,515,715 | 7/1950 | Jones | D3/53 X |
| 2,904,090 | 9/1959 | Rudberg | 150/137 |
| 3,063,487 | 11/1962 | Mullin | D3/53 X |
| 3,596,757 | 8/1971 | Cocchiaraley | 150/137 X |

*Primary Examiner*—Henry F. Epstein

[57] ABSTRACT

A versatile minipurse for carrying pocket money, including a resilient flat hollow enclosure of the type having a slit across one surface which spreads when the enclosure is deformed by squeezing along the length of the slit, a clip along the lower surface of the enclosure, and one or more connecting devices joining the enclosure and the clip at one or more points along a line transverse to the slit. Preferred embodiments include connecting means which make the enclosure and clip detachable.

20 Claims, 7 Drawing Figures

VERSATILE MINIPURSE

FIELD OF THE INVENTION

This invention is related generally to purses for carrying pocket money and, more particularly, to small purses of the type which can be carried in a side pocket.

BACKGROUND OF THE INVENTION

It is and has always been just about everyone's concern how to carry the pocket money which is needed when one is out and about. The rise in credit card use has done nothing to end the need to carry pocket money.

The traditional ways of carrying pocket money are often objectionable to many, particularly to those who prefer to dress casually. To some, it is considered an inconvenience to carry a bulky wallet in one's hip pocket and loose change in another pocket, or to carry a voluminous women's pocketbook. Hip pocket wallets have a way of causing wear on the seat of the pants and, to some of ample physical proportions, hip pocket wallets tend to increase their rearward proportions to an unsatisfactory extent.

On the other hand, it is often considered insecure to carry loose bills and coins in one's pockets for obvious reasons. The parents of young children, who often must carry money for school lunches or the like, are concerned about the money falling out of pockets.

For children, and even for adults, it is often desirable to be able to securely carry both coins and bills without the bulkiness and inconvenience of wallets, pocketbooks and the like, while at other times to securely carry just coins or just bills.

Many prior purses addressing some of these problems and needs are complex and expensive.

There is a need for an improved device for carrying pocket money, which is small, non-bulky, may easily be carrid in one's side pocket, may securely carry both coins and bills, and which is simple and inexpensive. Furthermore, there is a need for such a device which may be adaptable for carrying either just coins or just bills at times when such is desirable.

The need for money-carrying devices of all kinds has been addressed by designers and inventors since just about the dawn of history, and the prior art includes purses of many sizes, shapes and types. Some prior art purses and money-carrying devices include those disclosed in the following U.S. Pat. Nos.: Re. 24,166; 2,298,945; Des. 142,357; Des. 169,825; Des. 170,796; Des. 186,933; 979,806; 1,138,882; 2,904,090; Des. 138,985; and 3,596,757.

A variety of coin purses, money clips, and combinations of the two have been disclosed in the prior art. Examples of combination devices are disclosed in several of the aforementioned patents, but a need remains for an improved small purse for carrying coins and bills.

One particularly advantageous and economic coin purse is the quick-opening and self-closing type disclosed in U.S. Pat. No. Re. 24,166 (Stiller). The present invention is an improvement on such prior art.

The resilient plastic coin purses of such patent have found wide usage, but their usefulness is limited to carrying of coins. No provision is made for carrying bills or other flat items like credit cards, and thus the resilient plastic coin purse has never been considered and could never be a replacement for the more complex, bulky and cumbersome wallets, purses and pocketbooks of the prior art which are used for such purposes.

Furthermore, the characteristics of extreme deformability and resiliency which allow such simple integrally-formed devices to function so well as coin enclosures also make it quite unlikely and unexpected that such devices could be considered as candidates for combination with apparatus of a type useful for holding bills and the like. Such devices undergo radical deformation in virtually every area and dimension when squeezed for opening, making any combination unlikely.

BRIEF SUMMARY OF THE INVENTION

This invention is an improved very small purse (minipurse) for carrying pocket money. The improved minipurse of this invention is versatile, capable of readily carrying both coins and bills in a side pocket or elsewhere, and in preferred embodiments capable of ready disassembly for separate carrying of coins or bills, as desired.

The minipurse of this invention overcomes the problems and drawbacks of the prior art. The device is non-bulky, simple and inexpensive in construction, and may be kept conveniently is a side pocket or elsewhere. The device securely protects the pocket money of its user from inadvertent lose. The invention provides an ideal money purse for small children or for adults who dislike the standard ways of holding their pocket money.

The minipurse of this invention includes a flat hollow enclosure of a type which will be described, a clip and connection means, all arranged together in a particular fashion which will be described in detail.

The flat hollow enclosure is of the prior-mentioned well-known type having a closed loop edge, preferably in an oval shape, and parallel upper and lower surfaces. The upper surface has a slit thereacross, from one point on the loop edge across to an opposite point. The enclosure is integrally formed of resilient plastic material which, after deformation, will quickly return to its shape.

When deformation is caused by squeezing the loop edge together along the slit line, the slit spreads open wide to expose the hollow interior of the enclosure. Upon release, the slit opening quickly closes, closing the enclosure.

The aforementioned clip is along the lower surface of the enclosure, the surface not having the slit opening, and is substantially within the bounds of the closed loop edge of the enclosure member. The clip has upper and lower portions which are biased together, preferably in U-shaped fashion, to allow the holding of one dollar bill or many dollar bills folded together. The upper portion of the clip is connected to the lower surface of the enclosure along a line transverse to the slit by connection means at at least one point, and preferably two or more points, along such transverse line.

It is very highly preferred that such line for connection be normal to the slit line. It is highly preferred that the connection means along the transverse line be the only connection means between the clip and enclosure.

While not wanting to be limited by any theoretical considerations, this invention is based in part upon the discovery that even upon extreme deformation of the enclosure described herein, a transverse line along the lower portion of the enclosure remains substantially linear, not undergoing significant deformation, and that this allows effective permanent or effective detachable interconnection of such an enclosure with a clip in the manner described.

Such connection is preferably in the form of one or more pairs of common male-female snap means. Most preferably, two pairs of snap means are used. Other sorts of connection means may be used instead, including permanent rivets or interconnecting fabric facings such as that known by the trademark VELCRO. Detachable snap means are highly preferred.

The clips used in this invention are preferably single bands, in which the upper and lower portions are part of the same band folded back on itself. Such bands are most preferably of metal, but various other materials such as fairly rigid plastics can be used.

In highly preferred embodiments, the clip is not only substantially within the bounds of the closed loop edge of the enclosure, the enclosure extends well beyond the clip at either end of the slit. This permits easy opening of the enclosure by the squeezing of the enclosure edge, since such squeezing is without interference from the clip.

It is preferred that the orientation of the clip on the lower surface of the enclosure be such that it is either along or perpendicularly across the slit line which is on the upper surface of the enclosure. In the first of these preferred orientations, the fold in the band forming the clip is substantially normal to the slit, and the upper and lower portions extend in the general direction of the slit line. In the second of these preferred orientations, the fold in the clip band is parallel to the slit and the upper and lower portions of the clip extend from the fold in a direction transverse to the slit line.

In using the terms "transverse", "normal", and "perpendicular" in this document, it is apparent that reference is being made to the relationship of projections of such lines, since the lines or directions compared are often skew lines, that is, lines which are offset in a third dimension. It is believed that striving for geometrical exactitude would detract, rather than add, to the clarity of this document.

The resilient enclosure used in this invention is preferably of an oval configuration, with the slit running across the widest dimension of the closed loop. While this shape is particularly advantageous, a variety of closed-loop shapes can be used.

OBJECTS OF THE INVENTION

It is an object of this invention to provide a small device for carrying pocket money which overcomes problems and deficiencies of the prior art.

Another object of this invention is to provide a small device for securely and conveniently carrying both coins and bills, and/or other flat documents such as credit cards.

Another object of this invention is to provide a minipurse which is non-bulky and may be easily carried in a side pocket.

Another object of this invention is to provide a small purse for carrying coins and bills and which is readily adapted for carrying just coins or just bills.

Another object of this invention is to provide a small purse which in simple and inexpensive in construction.

These and other objects will be apparent from the following additional description and from the drawings, wherein:

DETAILED DESCRIPTION OF PREFERRED EMBODIMENTS

Figure 5:
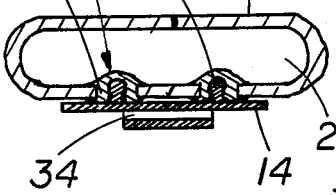
FIG. 5 is an end sectional view taken along section 5—5 as indicated in FIG. 4.
Figure 6:
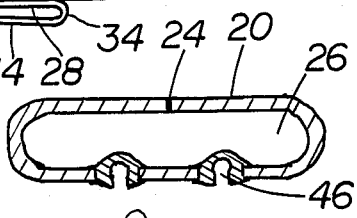
FIG. 6 is an end sectional view as is FIG. 5, but showing the device detached.
Figure 6:
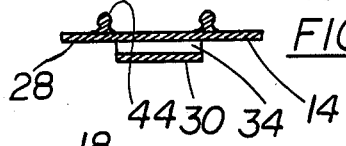

As shown in the figures, minipurse 10 includes an enclosure member 12, a clip 14, and means interconnecting enclosure 12 and clip 14. FIGS. 5 and 6 illustrate that enclosure 12 and clip 14 are joined by two pairs of interconnecting snap means 16.

Figure 1:
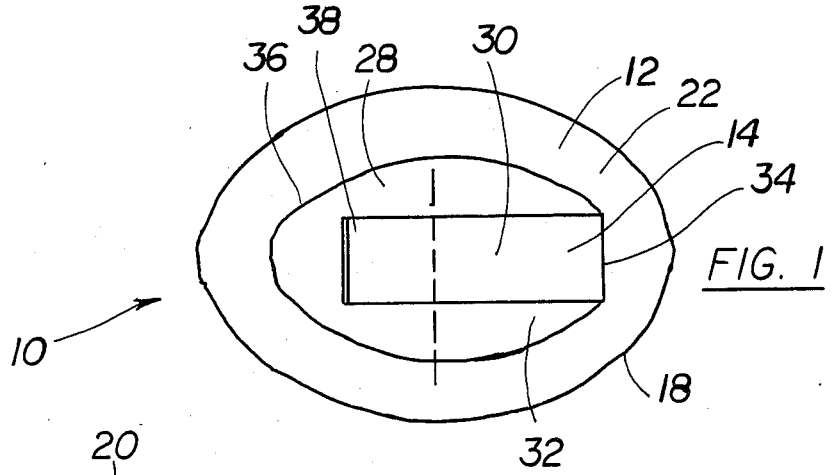
FIG. 1 is a bottom plan view of a preferred minipurse in accordance with this invention.
Figure 2:
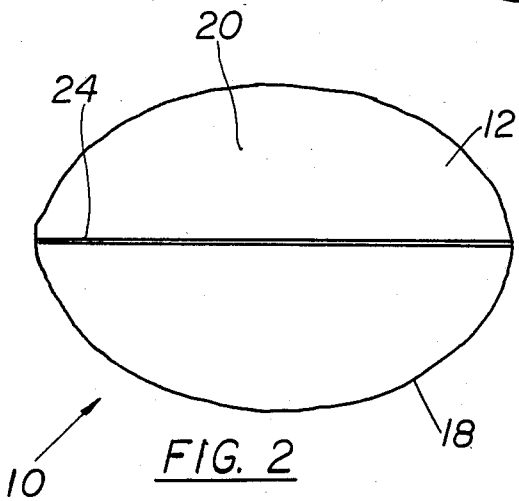
FIG. 2 is a top plan view of the device of FIG. 1.
Figure 4:
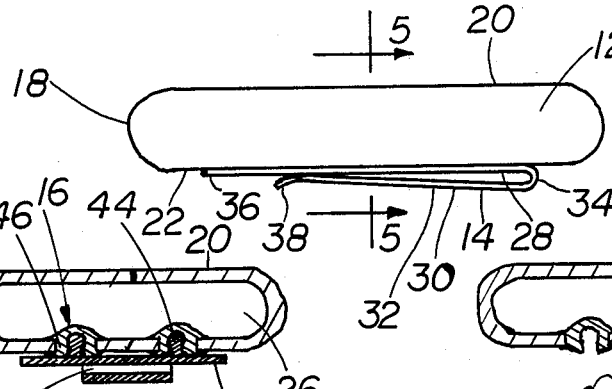
FIG. 4 is a front elevation of FIG. 2.
Figure 7:
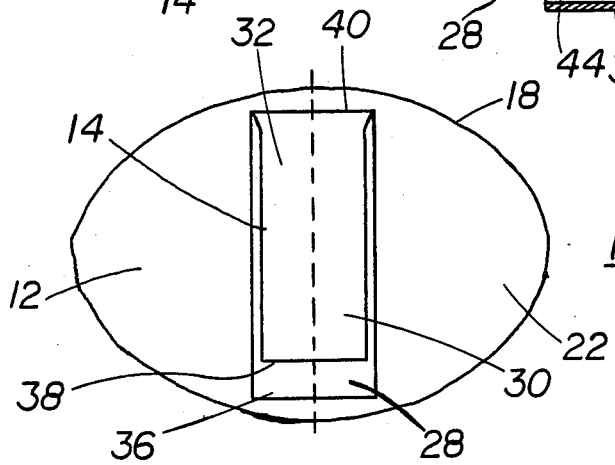
FIG. 7 is a bottom plan view as in FIG. 1, but showing an alternative preferred embodiment.

Enclosure 12 is an integrally formed resilient flat hollow member having a closed loop edge 18, an upper surface 20 and a lower surface 22. Closed loop edge 18 is generally oval in outline, as illustrated best in FIGS. 1, 2 and 7. As illustrated in FIGS. 4–6, closed loop edge 18 is a curved edge, which joins the corresponding edges of upper and lower surfaces 20 and 22.

Upper surface 20 has a slit 24 extending thereacross. Slit 24 runs across the oval shape of enclosure 12 at the widest point thereof. Slit 24 provides an opening into the hollow space 26, illustrated in FIGS. 5 and 6, which is defined within enclosure 12.

Figure 3:
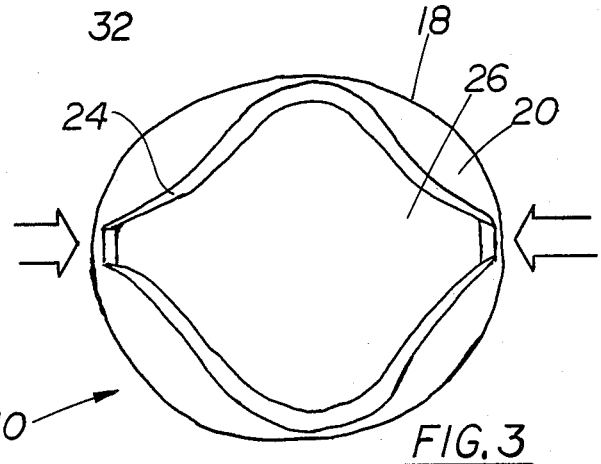
FIG. 3 is a top plan view as in FIG. 2, but showing te device deformed such that the enclosure is opened.

Enclosure 12 is made of a resilient plastic material which very quickly returns to its original shape after it has been deformed by squeezing. When enclosure 12 is squeezed by applying squeezing force to opposing portions of loop edge 18 at the opposite ends of slit 24, slit 24 spreads to open enclosure 12. This is illustrated in FIG. 3. Upon release of such squeezing force, the slit closes as enclosure 12 returns to the shape illustrated in FIGS. 1 and 2.

Clip 14 has an upper portion 28 and a lower portion 30. Upper and lower portions 28 and 30 are both part of a single band 32 which is folded back on itself along fold 34. Upper and lower portions 28 and 30 terminate in upper end 36 and lower end 38, respectively. Upper and lower ends 36 and 38 are biased together by the spring tension within band 32. These ends are flared outwardly somewhat to facilitate the placement of dollar bills into clip 14, as is common with certain moneyclips.

In the embodiment illustrated in FIGS. 1–6, fold 34 of clip 14 is substantially normal to slit 24. Thus, upper and lower portions 28 and 30 of clip 14 extend from fold 34 in a direction along slit 24. In the alternative embodiment illustrated in FIG. 7, fold 40 of clip 42 is substantially parallel to the slit (not shown) and the upper and lower portions of clip 42 extend from fold 40 in a direction along a line transverse to the slit. Indeed, they extend along a line perpendicular to the slit.

In both embodiments shown in the figures, enclosures 12 extend well beyond the clips such that enclosures 12 may easily be squeezed in a direction along their slits for opening without any interference from the clips. The design and dimensioning of the clips in the minipurse of this invention can accommodate easy opening of enclosure 12.

Furthermore, the design and dimensioning of the clips can be such as to avoid any overhang of the clips beyond the bounds of loop edge 18. Maintaining the clips within loop edge 18 eliminates garment wear from blunt clip edges and further eliminates undue wear on the connecting means between the enclosure and clip.

The connecting means joining an enclosure and clip in the minipurse of this invention are along a line transverse to the slit, regardless of the orientation of the clip with respect to the enclosure. Thus, for each of the two embodiments illustrated in the figures, two pairs of snaps are spaced along a line perpendicular to the slit of the enclosure. Such transverse line is illustrated by the dotted lines in FIGS. 1 and 7, although the snaps themselves are covered in such figures. Even when enclosures 12 are severely deformed to open slits 24, lower surfaces 22 of enclosures 12 remain substantially undeformed along such transverse lines, so that the interconnection of enclosures and clips along such line withstand repeated deformation of the enclosures.

The connecting means are illustrated in FIG. 5, a sectional taken along a line perpendicular to slit 24, and FIG. 6. Extending upwardly from the upper portion of clip 14 are two male snap members 44 which are affixed thereto. Facing downwardly and attached to lower surface 22 are two female snap members 46 which are affixed thereto in position to receive male snap members 44. When the pairs of snap members are engaged, clip 14 is firmly attached to enclosure 12. However, minipurse 10 is adaptable such that detachment of clip 14 from enclosure 12 is possible for separate usage.

Male snap members 44 may be attached to upper portion 28 of clip 14 in a variety of known ways, such as welding, bonding with epoxy or other adhesives, or other bonding methods. Or, male snap members may be integrally formed with clip 14. Female snap members 46 may be attached to lower surface 22 of enclosure 12 by standard crimping methods or other well-known methods.

While the use of two pairs of snap members is preferred, three or more pairs of snap members may be used. And, a single pair of snap members may be used in some cases, although, depending on the type of snap means used, it may be difficult to maintain the proper relative orientation of the clip on the enclosure when only one pair of snap members is used. As previously noted, a variety of other permanent and detachable connecting means may be used. The snap means described have been found to be particularly beneficial.

Enclosure 12 is preferably integrally formed of a resilient plastic material. Plasticized polyvinyl chlorides are highly preferred materials for use in forming enclosure 12. A variety of other acceptable materials would be apparent to those skilled in the art. Attention is directed to U.S. Pat. No. Re. 24,166, which describes a method for manufacturing enclosures of the type useful in forming the minipurse of this invention. U.S. Pat. No. Re. 24,166, which is incorporated by reference, provides more information on acceptable materials.

The clips used in forming the minipurse of this invention are preferably made of metal with the natural spring tension needed to bias upper and lower portions 28 and 30 of the clip together. However, a variety of springy plastic materials may be used instead. The snap members are preferably made of metals commonly used for such purpose.

While the principles of this invention have been described in connection with specific embodiments, it should be understood clearly that these descriptions are made only by way of example and are not intended to limit the scope of this invention.

What is claimed is:

1. A versatile minipurse for carrying pocket money comprising:

a flat hollow one-piece enclosure having a substantially closed peripheral edge and substantially parallel upper and lower surfaces, the upper surface having a slit thereacross, said enclosure being integrally formed of resilient plastic material such that squeezing the peripheral edge at opposite ends of the slit spreads the slit to open the enclosure;

a one-piece clip along the lower outside surface substantially within the bounds of the peripheral edge and including upper and lower portions biased together; and means at at least one point along a line transverse to the slit to connect the upper portion of the clip to the lower surface of the enclosure.

2. The minipurse of claim 1 wherein the upper and lower portions of the clip are formed of a single band folded back on itself.

3. The minimpurse of claim 2 wherein the transverse line is substantially normal to the slit and the connection means therealong are substantially the only connection means.

4. The minipurse of claim 1 wherein the connection means is detachable such that the enclosure and clip may used either together or separately.

5. The minipurse of claim 4 wherein the connection means comprises at least one pair of male and female snap means, one of each pair being connected to the lower surface of the enclosure and the other of each pair being connected to the upper portion of the clip.

6. The minipurse of claim 5 wherein two pairs of snap means are spaced along the transverse line.

7. The minipurse of claim 4 wherein the enclosure extends well beyond the the clip at either end of the slit, whereby the enclosure may readily be opened upon the squeezing of its edge without interference from the clip.

8. The minipurse of claim 7 wherein the upper and lower portions of the clip are formed of a single band folded back on itself, the fold in the clip band is substantially parallel to the slit, and the upper and lower portions of the clip extend from the fold in a direction along the transverse line.

9. The minipurse of claim 7 wherein the upper and lower portions of the clip are formed of a single band folded back on itself and the fold of the clip band is substantially normal to the slit.

10. The minipurse of claim 3 wherein the enclosure is substantially oval-shaped.

11. The minipurse of claim 10 wherein the connection means is detachable such that the enclosure and clip may used either together or separately.

12. The minipurse of claim 11 wherein the connection means comprises at least one pair of male and female snap means, one of each pair being connected to the lower portion of the enclosure and the other of each pair being connected to the upper.

13. The minipurse of claim 12 wherein two pairs of snap means are spaced along the transverse line.

14. The minipurse of claim 11 wherein the enclosure extends well beyond the the clip at either end of the slit, whereby the enclosure may readily be opened upon the squeezing of its edge without interference from the clip.

15. The minipurse of claim 14 wherein the fold in the clip band is substantially parallel to the slit and the upper and lower portions of the clip extend from the fold in a direction along the transverse line.

16. The minipurse of claim 14 wherein the fold of the clip band is substantially normal to the slit.

17. A versatile minipurse for carrying pocket money comprising:

a flat hollow one-piece enclosure having upper and lower surfaces, the upper surface having a slit thereacross and the lower surfaces having an edge and a central area spaced inwardly from the edge, said enclosure being resilient such that squeezing at opposite ends of the slit spreads the slit to open the enclosure;

a one-piece clip along the lower surface including upper and lower portions biased together; and means in said central area connecting the clip to the enclosure, thereby providing in combination means to contain coins and hold bills.

18. The minipurse of claim 17 wherein the connection means is detachable such that the enclosure and clip may used either together or separately.

19. The minipurse of claim 18 wherein the connection means comprises pairs of male and female snap means spaced along a line substantially normal to the slit, one of each pair being connected to the lower portion of the enclosure and the other of each pair being connected to the upper.

20. The minipurse of claim 19 wherein the enclosure extends well beyond the the clip at either end of the slit, whereby the enclosure may readily be opened upon the squeezing of its edge without interference from the clip.

* * * * *